US005524876A

United States Patent [19]

Porter

[11] Patent Number: 5,524,876

[45] Date of Patent: Jun. 11, 1996

[54] METHOD AND APPARATUS FOR DELIVERING AND STACKING ENVELOPES IN AN ENVELOPE MACHINE

[75] Inventor: Jeremy Porter, Oberlahr, Germany

[73] Assignee: F. L. Smithe Machine Company, Inc., Duncansville, Pa.

[21] Appl. No.: 361,750

[22] Filed: Dec. 22, 1994

[51] Int. Cl.[6] ..... B65H 29/40

[52] U.S. Cl. ..... 271/178; 271/315

[58] Field of Search ..... 271/2, 177, 178, 271/187, 214, 215, 216, 315

[56] References Cited

U.S. PATENT DOCUMENTS

| | | | |
|---|---|---|---|
| Re. 26,348 | 2/1968 | Ciccone | 93/93 |
| 1,791,569 | 2/1931 | Novick . | |
| 2,140,112 | 12/1938 | Novick | 271/69 |
| 2,232,720 | 2/1941 | Novick | 93/75 |
| 2,232,721 | 2/1941 | Novick | 271/87 |
| 2,787,468 | 4/1957 | Novick | 271/87 |
| 2,853,298 | 9/1958 | Faeber | 271/214 X |
| 2,856,189 | 10/1958 | Winkler et al. | 271/214 X |
| 3,116,668 | 1/1964 | Novick | 93/62 |
| 3,162,438 | 12/1964 | Perry, Jr. | 271/187 |
| 3,593,486 | 7/1971 | Helm | 53/31 |
| 3,641,883 | 2/1972 | Smithe et al. | 93/62 |
| 3,811,549 | 5/1974 | Preisig | 271/214 X |
| 3,865,365 | 2/1975 | Hardin et al. | 271/214 |
| 4,275,874 | 6/1981 | DiBlasio | 271/187 X |
| 4,524,965 | 6/1985 | Kulpa | 271/214 |
| 4,915,371 | 4/1990 | Quinton | 271/187 X |

FOREIGN PATENT DOCUMENTS

| | | | |
|---|---|---|---|
| 0040476 | 3/1979 | Japan | 271/214 |
| 0037039 | 2/1988 | Japan | 271/315 |

OTHER PUBLICATIONS

J. S. Moffitt, Powered Document Stacker, IBM Technical Disclosure Bulletin vol. 20 No. 3, pp. 1185–1186, Aug. 1977.

*Primary Examiner*—William E. Terrell
*Assistant Examiner*—Tamara Kelly
*Attorney, Agent, or Firm*—Price & Adams

[57] ABSTRACT

Finished envelopes are conveyed in a feed line of an envelope forming machine aligned in spaced apart relation to a spiral delivery mechanism that transfers the envelopes on edge to the surface of a delivery table. A conveyor on the delivery table sequentially advances the envelopes in a stacked relation from a receiving end portion to a discharge end portion where a predetermined quantity of stacked envelopes are periodically removed from the table as envelopes are added to the stack at the receiving end portion of the table. The envelopes are maintained in a compact stack by a stop member which is normally biased toward the receiving end portion of the table by an actuator mechanism. The stop member exerts pressure on the stack as it advances upon the addition of envelopes from the receiving end portion to the discharge end portion. The stop member maintains the envelopes vertically aligned in a compact arrangement as additional envelopes are added to the stack and the stack advances toward the discharge end. After a predetermined quantity of envelopes are stacked on the table, the operator removes the stack. The stop member then automatically advances under the force of the actuator toward the receiving end into abutment with the last envelope in the stack to maintain the stack compact and prevent the stacked envelopes from becoming misaligned on the delivery table.

20 Claims, 3 Drawing Sheets

METHOD AND APPARATUS FOR DELIVERING AND STACKING ENVELOPES IN AN ENVELOPE MACHINE

BACKGROUND OF THE INVENTION

1. Field of the Invention

This invention relates to method and apparatus for delivering finished envelopes conveyed horizontally in spaced relationship and transferred to a table where the envelopes are stacked in a compact arrangement on edge and more particularly to a delivery table that maintains the envelopes stacked on edge as the envelopes are delivered to the table and selected quantities of envelopes are periodically removed from the table while the envelopes continue to be transferred on edge to the table.

2. Description of the Prior Art

In the manufacture of envelopes, it is the conventional practice to convey the finished envelopes sequentially either horizontally in spaced apart relation on a conveyor or sequentially in a feed path by rotating cylinders in which the finished envelopes are transferred in the feed path from the surface of one cylinder to the next. The spaced apart finished envelopes are directed individually and sequentially into the slots formed in a conventional delivery spiral which include aligned slotted stacker wheels.

Each slotted wheel includes a plurality of spirally extending fingers which form slots in the periphery of the wheels. The slotted wheels are mounted on a shaft which is rotated in time relation to the mechanism that feeds the finished envelopes sequentially in spaced apart relation. As the envelopes are advanced to the delivery spiral, each envelope moves into a parallel set of slots formed by the extending fingers of each of the aligned wheels.

After the envelope enters the slot it is carried around on the wheels until the seal flap edge of the envelope strikes a delivery table which is positioned down stream of the delivery spiral. The envelopes are transferred from the slotted wheels to a vertical position with the seal flap edge of each envelope positioned downwardly on the delivery table. Generally, the delivery table extends in a horizontal position from the slotted wheels. On the delivery table the finished envelopes are stacked in a compact arrangement where periodically a predetermined number of envelopes are removed for packaging. U.S. Pat. No. Re. 26,348 is representative of known delivery and stacking mechanisms for envelope machines.

U.S. Pat. Nos. 3,116,668; 3,593,486; and 3,641,883 are further examples of envelope delivery and stacking mechanisms in which envelopes are conveyed in a circular path by folding and transfer cylinders that complete the folding operations of the envelope before they are transferred into the slots of a delivery spiral. The envelopes are retained on the surface of the seal fold and transfer cylinders by a suction through vacuum ports. As the envelopes on the delivery cylinder approach the delivery spiral the vacuum force on the envelope is interrupted to release the envelopes and to sequentially transfer them into the slots of the delivery spiral.

From the delivery spiral they are positioned in a stack in a selected position. In one arrangement the envelopes may be stacked with their seal flaps folded and into contact with the delivery table. In another arrangement the envelopes may be stacked with the closure flaps in an opened position and extending upwardly from the table.

Once the finished envelopes are transferred to the delivery table and stacked on edge a predetermined number of the envelopes are periodically removed from the direct feed line. Banding mechanisms are known in which the envelopes in the feed line after stacking are shifted laterally to an adjacent banding mechanism. The banding mechanism automatically bands a pack of predetermined number of envelopes. Generally the lateral movement and subsequent banding is not desired.

Preferably the envelopes are fed in a stack on the delivery table in a direct line of the envelope machine and a predetermined number of stacked envelopes are removed from the feed line. During this process of stacking and removing a predetermined number of envelopes from the delivery table envelopes continue to be transferred from the spiral delivery onto the delivery table. Therefore, the envelopes being transferred onto the delivery table must be maintained in a stacked relationship as a predetermined quantity of stacked envelopes are removed from the feed line. This requires that the envelopes arriving onto the delivery table be maintained in a stacked relation and do not become misaligned as a quantity of envelopes are removed.

U.S. Pat. Nos. 1,791,569; 2,140,112; and 2,232,720 disclose delivery mechanisms in sheet feeding operations, such as envelope machines, which utilize helical feeding devices or screw conveyors. The helices or convolutions are supported by a rotating shaft and are spaced apart to receive the bottom edge of a finished envelope. As the helical conveyor is rotated envelopes are sequentially inserted in the spaces between the helices. The helices propel the envelopes individually in stacked relation onto the delivery table.

In U.S. Pat. No. 2,140,112 as the helical conveyor transfers the envelopes on edge to the delivery table pins projecting from the table engage the lower edges of the envelopes to support the envelopes on edge as they are propelled by the helices to the stack. A stop is positioned on the table in opposed relation to the helices. As the envelopes are added to the stack the stop is pushed by the accumulating envelopes away from the helices but resists such movement and serves to hold the envelopes of the stack compactly together.

The delivery table conventionally uses a conveyor to transport the envelopes in stacked relation from the receiving end of the table to the rearward end where the envelopes are compactly stacked and are removed in a predetermined quantity from the table. This requires that the speed of travel of the stacked envelopes on the table is somewhat slower than the travel of the finished envelopes in the feed line as they approach the spiral delivery. As the envelopes are stacked on edge on the delivery table they are advanced by the conveyor at a speed where the newly arriving envelopes onto the table generate a pushing action against the rear of the stack.

U.S. Pat. Nos. 2,232,721 and 2,787,468 disclose feeding and stacking mechanisms for envelope making machines that utilize gripper mechanisms which engage in timed relation with the operation of the feed conveyor the marginal portion of each envelope as it is transferred on edge to the delivery table. As each envelope is transferred on edge to the delivery table it is added to the stack of envelopes and engaged by a gripping mechanism which holds the envelope compactly in the stack. The gripping mechanism is momentarily released to permit the next envelope to be added to the stack and compacted therewith. As the envelopes are stacked on the table they are supported on a marginal edge by an adjustable side guide and supported in a stacked formation by a slidable stop.

The continued stacking of envelopes on the delivery table must be coordinated with the operation of removing a predetermined quantity of envelopes periodically from the stack. This requires that the envelopes being fed to the table be maintained in a stacked relation as a quantity of stacked envelopes are removed from the rearward end of the table.

Gripper devices and the like are positioned on the surface of the table in the feed line of the envelopes. Their operation must be coordinated with the continued feeding of the envelopes to the table. This necessitates a reduction in the working space available for the operator to remove a quantity of stacked envelopes from the table and increases the complexity of the stacking mechanism. The devices that shift stacked envelopes from the feed line laterally on the delivery table also decrease the operator's access to the stacked envelopes.

Therefore, there is need in envelope stacking mechanisms and particularly in an envelope delivery table for a device that maintains a compact arrangement of stacked envelopes on the table as a predetermined quantity envelopes are periodically removed from the rear as additional envelopes are conveyed to the table. As envelopes are removed, the remaining envelopes on the table must maintained in a compact stacked relationship.

SUMMARY OF THE INVENTION

In accordance with the present invention, there is provided an envelope delivery apparatus that includes a conveyor for transporting envelopes aligned in spaced relation. The conveyor has a discharge end portion. A delivery table is positioned in spaced relation to the conveyor discharge end portion. Feeder means positioned between the conveyor discharge end portion and the delivery table sequentially transfer the envelopes from the conveyor for edge stacking onto the delivery table. Means is provided for advancing the envelopes stacked on edge on the delivery table. Abutment means is supported for longitudinal movement on the discharge table for receiving and supporting the envelopes stacked on edge as the envelopes are transferred onto the delivery table. The abutment means are movable on the delivery table between a first position closely adjacent to the feeder means for receiving the envelopes stacked on edge and a second position advanced by the stacked envelopes to a second position for supporting preselected quantities of envelopes stacked on edge on the delivery table. Biasing means control the movement of the abutment means on the delivery table to maintain the envelopes in stacked relation as the envelopes are transferred onto the delivery table and the abutment means move between the first and second positions.

Further in accordance with the present invention, there is provided a delivery table for an envelope machine that includes an elongated body portion have an upper surface and a lower surface. The first end portion of the upper surface receives envelopes for edge-stacking thereon. A second end portion is spaced from the first end portion for receiving a predetermined quantity of envelopes stacked on edge between the first and second end portions. Means is provided for advancing the envelopes stacked on edge from the first end portion to the second end portion. A stop device is supported for movement on the upper surface between the first and second end portions. Actuator means normally urge the stop device toward the first end portion to receive envelopes sequentially transferred onto the upper surface and advanced on edge in stacked relation toward the second end portion. The stop device is advanced on the upper surface by the movement of the stacked envelopes against the force of the actuator means as envelopes are sequentially added to the stack. Means is provided for automatically returning the stop device to a position on the upper surface adjacent to the first end portion to support the stacked envelopes remaining on the upper surface after a predetermined quantity of stacked envelopes are removed from the upper surface and the actuator means urges the stop device to move toward the first end portion into contact with the stacked envelopes.

Additionally, the present invention includes a method for stacking envelopes on a delivery platform of an envelope machine that includes the steps of conveying envelopes aligned in spaced apart relation in a feed line. The envelopes are transferred from spaced apart relation in the feed line to a position on edge on a surface of a receiving end of a delivery platform. The envelopes are positioned in alignment on edge in a stack on the delivery platform. A stack of envelopes is advanced on the surface toward a discharge end of the delivery platform as individual envelopes are positioned on edge at the receiving end of the delivery platform. The envelopes are supported against a stop device as the envelopes are stacked and advanced on the delivery platform toward the discharge end. The stop device is moved in supporting relation with the stacked envelopes as the envelopes move in the compact stack from the receiving end to the discharge end of the delivery platform. A predetermined quantity of stacked envelopes are removed from the discharge end of the delivery platform as additional envelopes are added to the stack at the receiving end. The stop device automatically advances from the discharge end toward the receiving end to maintain the envelopes remaining on the delivery platform in a compact stack when the quantity of stacked envelopes are removed from the discharge end.

Accordingly, a principal object of the present invention is to provide method and apparatus for feeding envelopes in a stacked relation on a delivery table in the feed line of an envelope machine where the envelopes are maintained in a compact stack as a predetermined quantity of stacked envelopes are removed from one end of the table as additional envelopes are added to the stack remaining on the opposite end of the table.

Another object of the present invention is to provide method and apparatus for maintaining stacked envelopes of an envelope delivery table in a compact arrangement as the envelopes are continuously stacked on the table and periodically removed in a predetermined selected quantity.

Another object of the present invention is to provide a delivery table for an envelope machine in which envelopes are stacked on edge and advanced into supporting relation with a stop which progressively moves on the surface of the table as additional envelopes are added to the stack and automatically moves from one end of the table to the other into supporting relation with the stack of envelopes remaining on the table when a selected quantity of envelopes are removed from the table.

A further object of the present invention is to provide a method for maintaining envelopes in a compact stacked arrangement on a delivery table as individual envelopes are progressively stacked on the table and a quantity of stacked envelopes are removed from the table.

These and other objects of the present invention will be more completely disclosed and described in the following specification, the accompanying drawings, and the appended claims.

DESCRIPTION OF THE PREFERRED EMBODIMENTS

Figure 1:
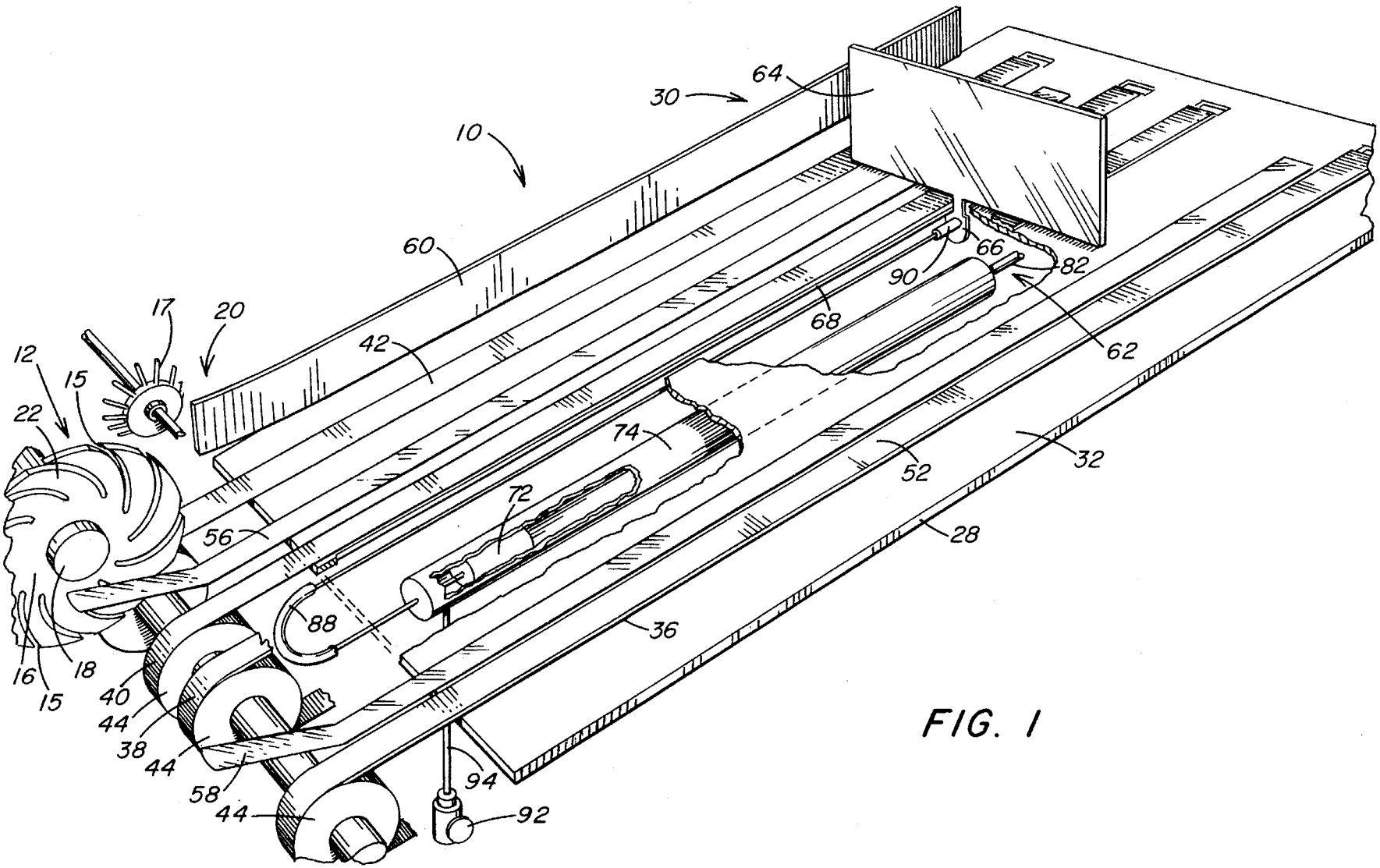
FIG. 1 is a fragmentary, isometric schematic illustration of a delivery table for an envelope machine, illustrating a stop mechanism for maintaining the envelopes in a compact stacked arrangement on the table.
Figure 2:
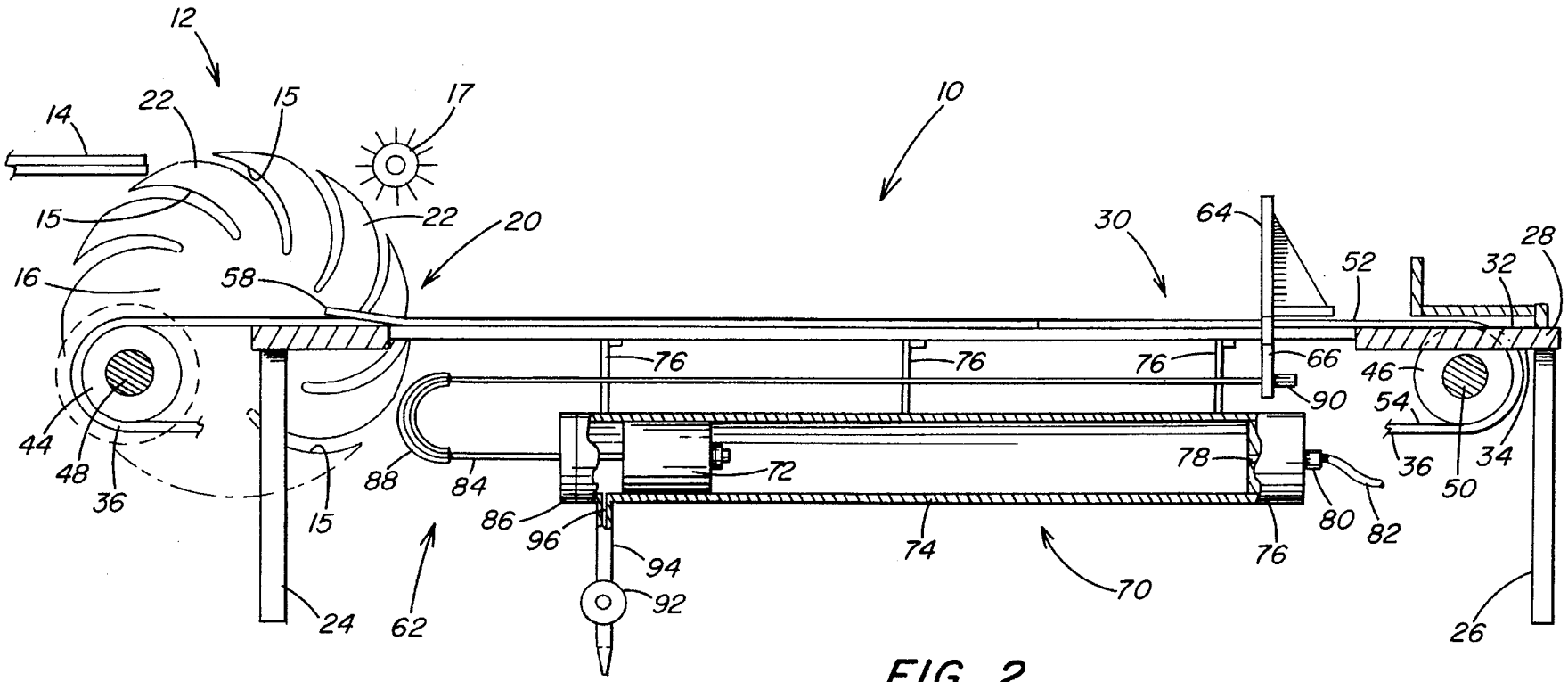
FIG. 2 is a fragmentary, partial sectional view in side elevation of the envelope machine delivery table shown in FIG. 1.

Referring to the drawings and particularly to FIGS. 1 and 2 there is illustrated a delivery table or platform generally designated by the numeral 10 positioned downstream of a transfer mechanism generally designated by the numeral 12 in a feed line of an envelope forming machine. Finished envelopes are transported by a horizontal conveyor 14 shown in FIG. 2. The finished envelopes are aligned in spaced apart relation on the surface of the conveyor 14. The envelopes are conveyed from the stations (not shown) of the envelope machine positioned upstream in the feed line from the delivery mechanism 12.

Once the envelopes are transferred to the conveyor 14, the assembly operations of the envelope are completed and the envelope is ready for stacking in a predetermined quantity with other envelopes for subsequent handling and shipment. It should be understood that in accordance with the present invention that finished envelopes may also be conveyed to the delivery mechanism 12 by other conveying devices such as transfer cylinders in which the finished envelopes after folding and gumming are conveyed on the surface of rotating cylinders to the delivery mechanism 12, such as disclosed in U.S. Pat. No. 3,641,883 which is incorporated herein by reference.

The spaced apart and aligned envelopes are fed by the conveyor 14 to the delivery mechanism 12 which preferably in one embodiment includes a conventional delivery spiral where each envelope is transferred into an arcuate receiving slot 15 for delivery on edge to form a stack of envelopes on the delivery table 10. In one embodiment, as illustrated in U.S. Pat. No. Re. 26,348 which is incorporated herein by reference, three stacker wheels 16 (one of which is shown in FIGS. 1 and 2) are supported for rotation with the shaft 18 rotatably supported in the envelope machine frame between the discharge end of conveyor 14 and a receiving end portion generally designated by the numeral 20 of the delivery table 10. Each stacker or spiral wheel 16 includes a plurality of spirally extending fingers 22 which form slots 15 in the periphery of the wheel 16. The slotted wheels 16 rotate in precise timed relation to the operations performed upstream in the envelope forming machine. As each envelope is moved forwardly by the conveyor 14, it is transferred into a parallel set of slots 15 formed by the extending fingers 22. After the envelope enters a slot 15, it is carried around on the wheels 16 until the seal flap edge of the envelope strikes the delivery table 10. A brush 17 mounted downstream of and adjacent to the wheels 16 assists in discharging the envelopes from the wheels 16.

The delivery table or platform 10 is supported substantially horizontally by vertically extending frame members 24 and 26 that are in turn suitably supported by the envelope machine frame (not shown). The frame members 24 and 26 support an elongated body portion 28 in a horizontal plane. The body portion 28 extends from the receiving end portion 20 adjacent to the slotted wheels 16 to a discharge end portion generally designated by the numeral 30 at the opposite end. The body portion or platform 28 includes an upper surface 32 and a lower surface 34 extending the length of the table 10 between the receiving end portion 12 and the discharge end portion 30.

A plurality of conveyor belts 36, 38, 40, and 42 extend the length of the delivery table 10 and are positioned in spaced relation to one another. The belts 36–42 are each rotatably supported by pulleys 44 at one end and by pulleys 46 at the opposite end. Each of the sets of pulleys for the respective conveyor belts are non-rotatably mounted on shafts 48 and 50. In one embodiment the shaft 48 is driven by a drive belt (not shown), and the shaft 50 is rotatably supported within the machine frame. With this arrangement the sets of pulleys 44 and 46 rotatably support the ends of the conveyor belts 36–42.

An upper reach 52 of each conveyor belt is supported by the table surface 32 and a lower reach 54 passes beneath the table 10. With this arrangement, rotation of the shaft 48 in a clockwise direction rotates the conveyor belts 36–42 from the table receiving end portion 20 to the table discharge end portion 30 to transport the envelopes stacked on edge as shown in FIGS. 3–6 on the table surface 32 from the receiving end portion to the discharge end portion 30.

As shown in FIGS. 1 and 2 the delivery table 10 includes tabs 56 and 58 that extend longitudinally on the table surface 32. The tabs 56 and 58 are positioned between and parallel to the conveyor belts 36–42 and extend at the table receiving end portion 20 in close proximity to the radius of the slotted wheels 16 to facilitate the transfer of the envelopes from the slotted wheels 16 to the delivery table 10.

As the slotted wheels 16 rotate in a clockwise direction they bring the envelopes retained into the slots 15 to a vertical position with the envelope seal flap extending downwardly. Upon continued rotation of the wheels the envelopes contact the tabs 56 and 58 and are moved out of the slots to a vertical position onto the tabs. The brush 17 urges the envelope into contact with the surface of the rotating conveyor belts 36–42. With the conveyor belts moving in a direction from the table receiving end portion 20 to the discharge end portion 30 the envelopes are vertically positioned with the seal flap edge in contact with the conveyor belts 36–42. The envelopes are transferred sequentially in timed relation onto the conveyor belts to form a stack of envelopes which are conveyed continuously across the surface of the table from the receiving end portion 20 to the discharge end portion 30.

As the envelopes are transferred from the feed line conveyor 14 by the slotted wheels 16 to the delivery table 10, the envelopes are maintained compactly in a stack in aligned position by an adjustable side guide 60. The guide 60 extends substantially the length of the table 10 and is laterally movable to engage the ends of the stacked envelopes as determined by the length of the envelopes. A stack abutment device generally designated by the numeral 62 includes an upstanding stop member 64 positioned substantially perpendicular to the guide 60. The stop member 64 is longitudinally movable on the table surface 32 between the receiving end portion 20 and the discharge end portion 30.

The stop member 64 includes a downwardly extending leg 66 retained, in one embodiment, within a slot 68 in the table surface 32. The slot 68 extends the length of the table 10 parallel to the feed path of the stacked envelopes on the table 10. Movement of the stop member 64 on the surface 32 of table 10 is automatically controlled by an actuator generally designated by the numeral 70. One embodiment of the actuator 70 is shown in detail in FIG. 2 and includes a piston 72 movably retained in a vacuum cylinder 74. The actuator 70 also includes a spring device or an electrically operated solenoid. The vacuum cylinder 74 is mounted by supports 76 below the table 10. One end portion 76 of the cylinder 74 includes a port 78 connected by a fitting 80 to a conduit 82 connected to a vacuum source (not shown).

The piston 72 is slidable the length of the cylinder 74. A cord 84, such as a nylon cord, is connected to the end of the piston 72 that is positioned oppositely of end 86 of the cylinder 74. The cord 84 extends through a sealed opening in the cylinder end portion 86. The cord extends from the cylinder 74 through an arcuately shaped guide 88 mounted on the bottom of the table 10. The guide 88 reverses the direction of the cord 84 to extend underneath the table 10 and above the cylinder 74 to an extreme end 90 of the cord which is connected to the depending leg 66 of the stop member 64.

The vacuum cylinder 74 also includes a relief valve 92 connected by a fitting 94 to a port 96 in the cylinder 74 adjacent the end portion 86. The relief valve 92 is connected to atmospheric air in comparison to the port 78 at the opposite end which is exposed to a vacuum. With this arrangement, a vacuum is formed within the cylinder 74 so that the piston 72 is normally biased or urged to a position adjacent to the cylinder end portion 86. In this position of the oiston 72 the cord 84 is drawn into the cylinder 74 to normally position the stop member 64 at the receiving end portion 20 of the table 10 adjacent to the slotted wheels 16.

Figure 3:
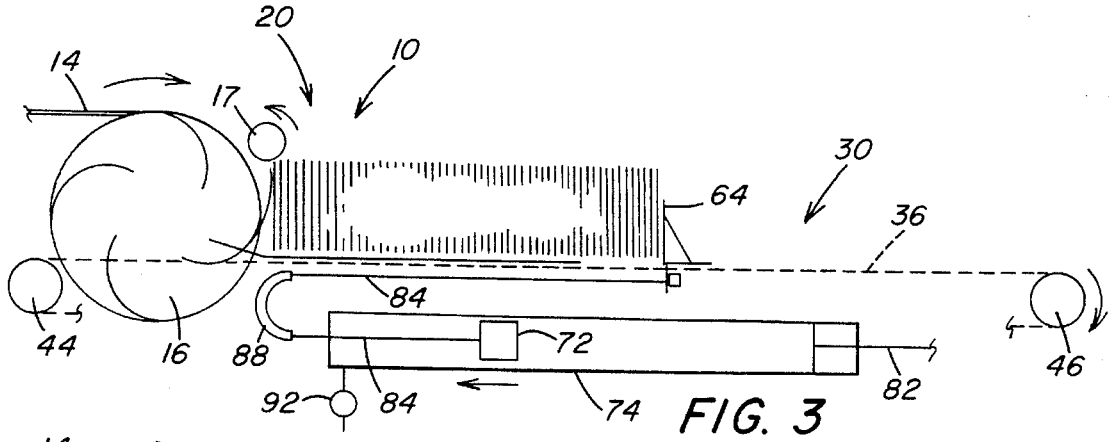
FIG. 3 is a schematic view in side elevation of the delivery table shown in FIGS. 1 and 2, illustrating a quantity of envelopes maintained by the stop device on edge in a compact stack.
Figure 4:
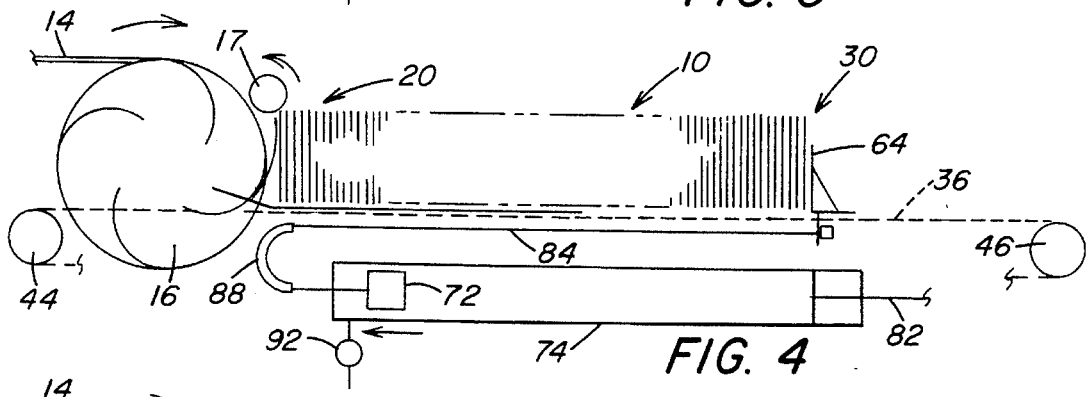
FIG. 4 is a view similar to FIG. 3, illustrating the automatic movement of the stop device rearwardly on the delivery table to maintain the envelopes in a compact stack as additional envelopes are added to the stack.

As shown in FIG. 3 the envelopes are sequentially transferred from the slotted wheels 16 onto the conveyor belts 36–42 of the delivery table 10. The stop member 64 receives the envelopes stacked on edge at the table receiving end portion 20. As the envelopes are added in stacked relation to the table, the movement of the stacked envelopes on the conveyors resists the force exerted by the stop member 64 against the envelopes. As more and more envelopes are added to the stack, the pushing force exerted by the stack against the stop member 64 overcomes the vacuum force exerted on the piston 72 to move the stop member 64 from the receiving end portion 20 to the discharge end portion 30. This operation is illustrated in FIGS. 3 and 4.

The stop member 64 by the action of the vacuum cylinder 74 maintains a resistive force on the envelopes as they are advanced by the conveyors 36–42 to keep the envelopes in a tightly compact stack. However, the force exerted by the stop member 64 is not greater than the conveying force exerted by the moving envelopes. The envelopes progressively are added in stacked relation onto the table 10. The stop 64 maintains the stack compact as the number of envelopes in the stack increases.

Figure 5:
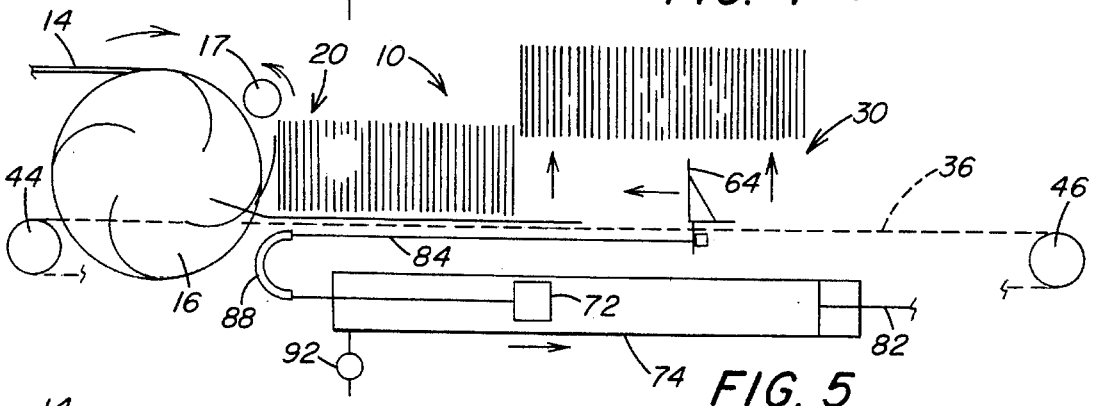
FIG. 5 is a view similar to FIGS. 3 and 4, illustrating the intermediate step of removing a predetermined quantity of stacked envelopes from the delivery table where the stop device is released for automatic advancement into supporting relation with the remaining envelope stacks on the delivery table.
Figure 6:
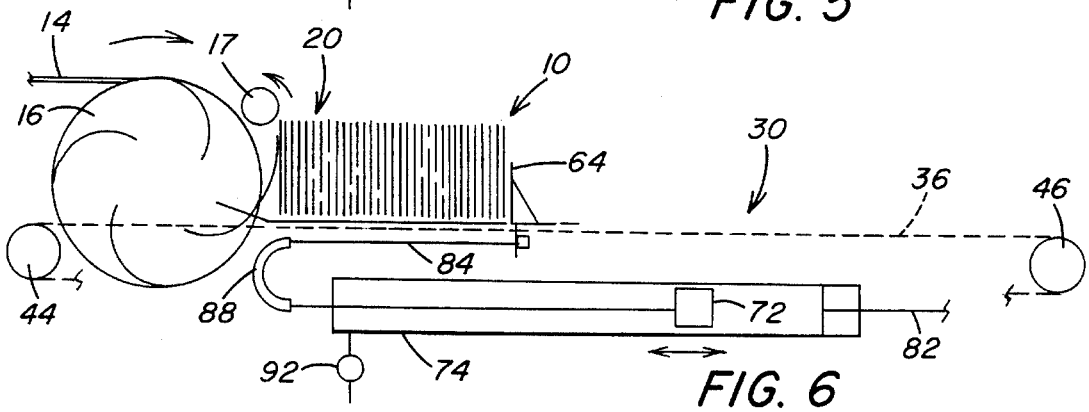
FIG. 6 is a further schematic illustration of the delivery table, illustrating the stop device returned to a position supporting the stack of envelopes after a quantity of envelopes has been removed.

Once a predetermined quantity of envelopes are stacked on edge on the delivery table 10 a quantity of envelopes are removed from the table as shown in FIG. 5. Generally the envelopes are removed in a selected quantity, for example a stack of 500 envelopes are removed at a time from the delivery table. U.S. Pat. No. Re. 26,348 discloses a system for determining when a preselected number of envelopes have been stacked onto the table 10. Then a number of envelopes are segregated from the remaining envelopes by displacing an envelope from the normal stacked position. This indicates to the operator that there is a predetermined number of envelopes between a displaced envelope and the stop member 64.

When a desired number of envelopes have been stacked on the delivery table 10 and suitably identified, the operator removes the predetermined number of envelopes for subsequent banding into packs of envelopes or to place them in a shipping container. This step in the stacking operation is illustrated in FIG. 5 in which a predetermined quantity of envelopes are removed from the other envelopes which remain in stacked relation on the delivery table 10. As soon as the stack of envelopes is removed from the table 10, the stack abutment mechanism 62 is automatically actuated by the vacuum cylinder 74 to advance the stop member 64 from the position shown in FIG. 5 toward the table receiving end portion 20 to a position on the table 10 where the stop member 64 is returned to abutting relation with the last envelope positioned in the stack remaining on the delivery table.

The speed or rate at which the stop member 64 advances into engagement with the remaining stacked envelopes once a quantity of envelopes is removed is controlled by operation of the relief valve 92 connected to atmospheric air pressure. Thus with this arrangement the tension exerted by the stop member 64 against the envelopes stacked on edge on the delivery table 10 is controlled by the vacuum force applied to the piston 72 within the cylinder 74. The speed at which the stop member 64 advances on the table when the pressure of the advancing stack is removed from the stop 64 is controlled by the relief valve 92.

With a vacuum applied to one side of the piston 72 the introduction of increased amounts of atmospheric pressure to the opposite side of the cylinder 72 increases the rate of travel of the piston 72 from cylinder end portion 86 to the cylinder end portion 76 and the rate of travel of the stop member 64 on the table. With this arrangement the envelopes are maintained in a compact stack on the delivery table 10.

During the period of time in which the operator is removing a stack of envelopes from the table 10, the stop member 64 automatically moves to a position to engage the remaining envelopes on the table. This allows the operator to concentrate on handling the envelopes away from the table without having to manually reposition a slidable stop to maintain the remaining envelopes in a stacked relationship. The provision of automatically returning the stop member 64 to abutment position with the stack does not impede or reduce the operator's access to the stacked envelopes on the table. The actuator 70 is maintained below the surface of the table and removed from the envelope feed line.

According to the provisions of the patents statutes, I have explained the principle, preferred constriction, and mode of operation of my invention and have illustrated and described what I now consider to represent its best embodiments. However, it should be understood that, within the scope of the appended claims, the invention may be practiced otherwise than as specifically illustrated and described.

I claim:

1. Envelope delivery apparatus comprising, a conveyor for transporting envelopes in aligned spaced relation, said conveyor having a discharge end portion, a delivery table positioned in spaced relation to said conveyor discharge end portion, feeder means positioned between said conveyor discharge end portion and said delivery table for sequentially transferring the envelopes from said conveyor for edge-stacking onto said delivery table, means for advancing the envelopes stacked on edge on said delivery table, abutment means supported for longitudinal movement on said discharge table for receiving and supporting the envelopes stacked on edge as the envelopes are transferred onto said delivery table, said abutment means movable on said delivery table between a first position closely adjacent to said feeder means for receiving the envelopes stacked on edge and a second position advanced by the stacked envelopes to a second position for supporting a predetermined quantity of envelopes stacked on edge on said delivery table, a cylinder assembly positioned beneath said delivery table, a piston movably retained in said cylinder assembly, means for connecting said piston in said cylinder assembly to said abutment means, and one end of said piston in said cylinder assembly being exposed to a force for positioning said piston in said cylinder to urge said abutment means toward feeder means to maintain the envelopes in stacked relation as the envelopes are transferred onto said delivery table and said abutment means moves between said first and second positions.

2. Envelope delivery apparatus as set forth in claim 1 in which, said abutment means includes an upstanding stop member longitudinally movable on said delivery table to support the envelopes stacked on edge on the delivery table.

3. Envelope delivery apparatus as set forth in claim 2 in which, said stop member includes a portion extending downwardly below said delivery table, a cord connected at one end to said piston in said cylinder assembly and at an opposite end to said stop member downwardly extending portion, and said piston normally urged to a position in said cylinder assembly to draw said cord into said cylinder assembly to normally position said stop member in said first position on said delivery table.

4. Envelope delivery apparatus as set forth in claim 3 in which, said stop member moves from said first position toward said second position on said delivery table against the normally biased force of said piston as more and more envelopes are transferred onto said delivery table.

5. Envelope delivery apparatus as set forth in claim 1 in which, one end of said piston in said cylinder assembly is exposed to a vacuum and an opposite end of said piston in said cylinder assembly is exposed to air under pressure, and said piston normally positioned in said cylinder assembly by said vacuum to urge said abutment means toward said feeder means to maintain the envelopes in stacked relation.

6. Envelope delivery apparatus as set forth in claim 5 in which, said abutment means overcomes the vacuum force exerted on said piston as more and more envelopes are added to the stack to move said abutment means from said first position on said delivery table to said second position on said delivery table.

7. Envelope delivery apparatus as set forth in claim 1 in which, said abutment means under the force exerted by said piston in said cylinder assembly maintains a resistive force on the envelopes as the envelopes are stacked onto said delivery table.

8. Envelope delivery apparatus as set forth in claim 7 in which, said abutment means maintains the envelope stacked compactly on said delivery table as the number of envelopes in the stack increases.

9. A delivery table for an envelope machine comprising, an elongated body portion having an upper surface and a lower surface, a first end portion of said upper surface for receiving envelopes for edge-stacking thereon, a second end portion spaced from said first end portion for receiving a predetermined quantity of envelopes stacked on edge between said first and second end portions, means for advancing the envelopes stacked on edge from said first end portion to said second end portion, a stop device supported for movement on said upper surface between said first and second end portions, a cylinder assembly positioned beneath said elongated body portion, a piston movably retained in said cylinder assembly, means for connecting said piston in said cylinder assembly to said stop device, one end of said piston in said cylinder assembly being exposed to a force for positioning said piston in said cylinder to urge said stop device toward said first end portion to maintain the envelopes in stacked relation as the envelopes are added to the stack, said stop device being advanced on said upper surface by movement of the stacked envelopes against the force on said piston as envelopes are sequentially added to the stack, and said piston movable in said cylinder to return said stop device to a position on said upper surface adjacent to said first end portion to support the stacked envelopes remaining on said upper surface after a predetermined quantity of stacked envelopes are removed from said upper surface and said piston urges said stop device to move toward said first end portion into contact with the stacked envelopes.

10. A delivery table for an envelope machine as set forth in claim 9 in which, said stop device extends upon on said upper surface and moves longitudinally thereon to support the envelopes stacked on edge on the delivery table.

11. A delivery table for an envelope machine as set forth in claim 10 in which, said stop device includes a portion extending downwardly below the delivery table, a cord connected at one end to said piston in said cylinder assembly and at an opposite end to said stop device downwardly extending portion, and said piston normally urged to a position in said cylinder assembly to draw said cord into said cylinder assembly to normally position said stop device in said first position on the delivery table.

12. A delivery table for an envelope machine as set forth in claim 11 in which, said stop device moves from said first position toward said second position on the delivery table against the normally biased force of said piston as more and more envelopes are transferred onto the delivery table.

13. Envelope delivery apparatus as set forth in claim 9 in which, one end of said piston in said cylinder assembly is exposed to a vacuum and an opposite end of said piston in said cylinder assembly is exposed to air under pressure, and said piston normally positioned in said cylinder assembly by said vacuum to urge said stop device toward said first end portion to maintain the envelopes in stacked relation.

14. A delivery table for an envelope machine as set forth in claim 13 in which, said stop device overcomes the vacuum force exerted on said piston as more and more envelopes are added to the stack to move said stop device from said first position on the delivery table to said second position on the delivery table.

15. A delivery table for an envelope machine as set forth in claim 9 in which, said stop device under the force exerted by said piston in said cylinder assembly maintains a resistive force on the envelopes as the envelopes are stacked onto the delivery table.

16. A method for stacking envelopes on a delivery platform of an envelope forming machine comprising the steps of, conveying envelopes aligned in spaced apart relation in a feed line, transferring the envelopes from spaced apart relation in the feed line to a position on edge on a surface of a receiving end of a delivery platform, positioning the envelopes in alignment on edge in a stack on the delivery platform, advancing the stack of envelopes on the surface toward a discharge end of the delivery platform as individual envelopes are positioned on edge at the receiving end of the delivery platform, supporting the envelopes against a movable stop device as the envelopes are stacked and advanced on the delivery platform toward the discharge end, connecting the stop to a piston in a cylinder assembly positioned beneath the delivery platform, exerting a force on the piston in the cylinder assembly to normally position the piston to urge the stop device toward the receiving end of the delivery platform, moving the stop device in supporting relation with the stacked envelopes as envelopes move in the compact stack from the receiving end to the discharge end of the delivery platform, removing a predetermined quantity of stacked envelopes from the discharge end of the delivery platform as additional envelopes are added to the stack on the receiving end, and advancing automatically the stop device by movement of the piston in the cylinder assembly from the discharge end toward the receiving end to maintain the stack of envelopes remaining on the delivery platform in a compact stack when the predetermined quantity of stacked envelopes are removed from the discharge end.

17. A method for stacking envelopes as set forth in claim 16 which includes, exposing a vacuum to one end of the piston in the cylinder assembly and air under pressure to an opposite end of the piston in the cylinder assembly, and normally positioning the piston in the cylinder assembly by the vacuum to urge the stop device toward the receiving end of the delivery platform.

18. A method for stacking envelopes as set forth in claim 17 which includes, maintaining a resistive force through the vacuum on the piston by the stop device as the envelopes are stacked on the delivery platform.

19. A method for stacking envelopes as set forth in claim 16 which includes, controlling the rate the stop device advances into engagement with the stacked envelopes on the delivery platform when a quantity of stacked envelopes are removed from the delivery platform.

20. A method for stacking envelopes as set forth in claim 16 which includes, automatically moving the stop device to a position on the delivery platform to engage the remaining envelopes on the delivery platform when a predetermined number of stacked envelopes are removed therefrom.

* * * * *

UNITED STATES PATENT AND TRADEMARK OFFICE

CERTIFICATE OF CORRECTION

PATENT NO. : 5,524,876
DATED : June 11, 1996
INVENTOR(S) : Jeremy Porter

It is certified that error appears in the above-indentified patent and that said Letters Patent is hereby corrected as shown below:

Column 3, line 55, delete "have" and insert --having--; and

Column 7, line 46, delete "oiston" and insert --piston--.

Signed and Sealed this

Twenty-second Day of October, 1996

*Attest:*

BRUCE LEHMAN

*Attesting Officer*

*Commissioner of Patents and Trademarks*